United States Patent [19]

Berler

[11] 4,249,268

[45] Feb. 10, 1981

[54] GARMENT COMPOSED OF NON-STRETCHABLE BODY PORTION ENTIRELY COVERED BY LOOP FASTENERS AND STRETCHABLE PORTIONS NOT SO COVERED

[76] Inventor: Herbert Berler, 38-15 Bowne St., Flushing, N.Y. 11354

[21] Appl. No.: 43,858

[22] Filed: May 30, 1979

[51] Int. Cl.[3] ..... A41B 1/00

[52] U.S. Cl. ..... 2/115; 40/586

[58] Field of Search ..... 2/115, 125, DIG. 6; 40/586, 618

[56] References Cited

U.S. PATENT DOCUMENTS

| | | | |
|---|---|---|---|
| 1,714,491 | 5/1929 | Burr | 2/125 X |
| 2,642,570 | 6/1953 | Heilbronner | 2/115 X |
| 2,986,740 | 6/1961 | Schudson | 2/115 |
| 3,122,753 | 3/1964 | Smith | 2/125 X |
| 3,484,974 | 12/1969 | Culmone | 2/115 X |
| 3,724,101 | 4/1973 | Slezak | 40/586 X |

*Primary Examiner*—Peter P. Nerbun

*Attorney, Agent, or Firm*—Jordan and Hamburg

[57] ABSTRACT

There is provided a garment consisting essentially of a main fabric having a plurality of loop elements on an outer surface thereof for removably attaching ornaments thereto. The garment includes a neck opening adapted for insertion of a wearer's head when the garment is donned, and a portion surrounding the neck opening is formed of a stretchable fabric to permit the wearer's head to pass through the neck opening in the case when the neck opening is smaller than the wearer's head.

3 Claims, 7 Drawing Figures

GARMENT COMPOSED OF NON-STRETCHABLE BODY PORTION ENTIRELY COVERED BY LOOP FASTENERS AND STRETCHABLE PORTIONS NOT SO COVERED

BACKGROUND OF THE INVENTION AND PRIOR ART STATEMENT

This invention relates to a garment, more particularly a shirt or jersey type garment to which ornaments or characters are removably attached. The term "ornaments" as employed herein is intended to include characters.

In the past, there have been disclosed garments including a fastening fabric having first fastening members on an outer surface thereof which detachably engage complementary fastening members provided on a rear surface of the ornaments, so that the ornaments can be attached to the garments. The fastening fabric is generally pre-shrunk to ensure dimensional stability and flatness, and the back thereof is coated with resin to ensure uniformity and integrity. Therefore, the fastening fabric does not have any elasticity.

Due to the above characteristics of the fabric, when making a T-shirt type garment from the fabric, the garment should have an opening large enough to allow the wearer's head to pass therethrough. Otherwise, it is necessary to secure the fabric to a conventional type shirt having a sufficient elasticity.

In U.S. Pat. No. 3,484,974, there is disclosed removable identifying characters for clothing, wherein an elongated flexible strip having fine loops on the outer surface thereof is secured to the back of a shirt. The characters include a plurality of hooking elements on the rear surface thereof which detachably engage the loops of the strip, so that the characters are removably secured to the shirt.

French Pat. No. 1,497,611 also shows a combination of a shirt and a strip removably secured to the shirt, in which a plurality of fastening members and complementary fastening members are permanently secured to the shirt and the strip respectively. When the strip is pressed against the fastening members of the shirt, the complementary fastening members engage the fastening members, whereby the strip is secured to the shirt.

Therefore, an object of the invention is to provide a garment substantially formed of a main fabric to which ornaments are removably attached.

Another object of the invention is to provide a garment, sections of which are formed of a stretchable fabric so that the garment may be donned easily.

A further object of the invention is to provide a kit including the garment having the characteristics stated above and ornaments removably securable thereto.

Still further objects and advantages of the invention will be apparent from the following description.

SUMMARY OF THE INVENTION

In accordance with the invention, there is provided a garment to which ornaments are removably attached. The garment consists essentially of a main fabric having a plurality of loop elements on an outer surface thereof, the garment including a neck opening adapted for insertion of a wearer's head when the garment is donned, a portion of the garment surrounding the neck opening being formed of a stretchable fabric to permit the wearer's head to pass through the neck opening in case the neck opening is smaller than the wearer's head.

The garment may also include at least one body strip extending in the longitudinal direction of a body section of the garment, which is formed of a stretchable fabric to make the garment more comfortable, yet quite body-conforming. Preferably, two body strips are provided along both sides of the body section of the garment. In case the garment includes a pair of sleeve sections, each sleeve section is preferably provided with a sleeve strip formed of a stretchable fabric which extends in the longitudinal direction of the sleeve section of the garment.

In accordance with another aspect of the invention, there is provided a kit comprising the garment stated above and at least one ornament having a plurality of hook elements on a rear surface thereof adapted to engage the loop elements of the main fabric, whereby the ornament is separably attached to the garment. The kit may include a supplemental fabric having a plurality of loop elements on an outer surface thereof for storing the ornaments thereon when the ornaments are not attached to the garment.

DETAILED DESCRIPTION OF A PREFERRED EMBODIMENT

Figure 1:
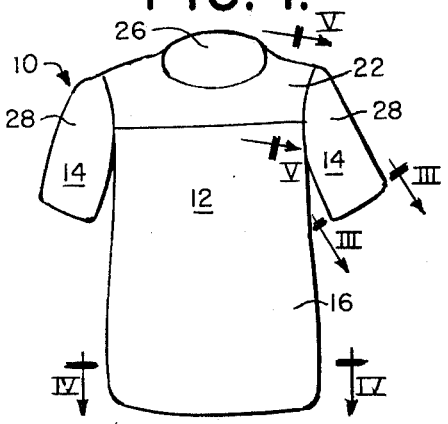
FIG. 1 is a perspective front view of the garment according to the invention.
Figure 2:
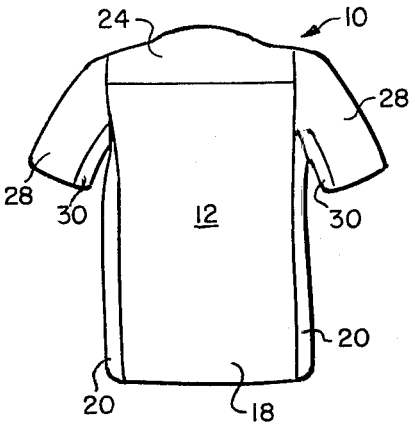
FIG. 2 is a perspective rear view of the garment shown in FIG. 1.
Figure 3:
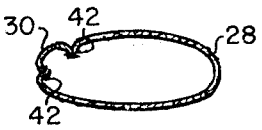
FIG. 3 is an enlarged cross-section view taken along the line III—III in FIG. 1.
Figure 5:
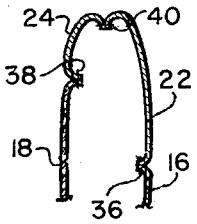
FIG. 5 is an enlarged cross-section view taken along the line V—V in FIG. 1.
Figure 4:
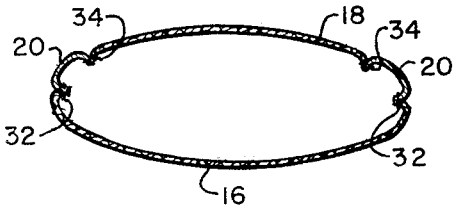
FIG. 4 is an enlarged cross-section view taken along the line IV—IV in FIG. 1.

Referring to FIGS. 1 to 5, there is shown a shirt 10 including a body section 12 and two sleeve sections 14 secured to the body section 12 by stitching as with conventional shirts.

The body section 12 comprises a front panel 16, a back panel 18, side segments 20 provided between the front and back panels 16 and 18, and shoulder segments 22 and 24 having an opening 26 adapted for insertion of a wearer's head. Each sleeve section 14 comprises a sleeve panel 28 and a sleeve segment 30 extending in the longitudinal direction of the sleeve.

The side segments 20 are secured to the front panel 16 by stitching 32 and to the back panel 18 by stitching 34 respectively. An upper edge of the front panel 16 is connected to a lower edge of the shoulder segment 22 by stitching 36 and an upper edge of the back panel 18 is also connected to a lower edge of the shoulder segment 24 by stitching 38. Stitching 40 connects upper edges of the shoulder segments 22 and 24 together except at the opening 26. Longitudinal edges of the sleeve segment 30 are secured by stitching 42 to the sleeve panel 28.

The front, back and sleeve panels 16, 18 and 28 are formed of the same type fabric having a plurality of loop elements 44 on the outer surface thereof, the rear surface of which is coated with resin to ensure uniformity and integrity of the fabric, so that the panels do not have any elasticity. However, the side, shoulder and sleeve segments 20, 22, 24 and 30 are formed of a stretchable fabric, such as a conventional knit T-shirt or jersey fabric and the like.

Since the opening 26 is provided within the shoulder segments 22 and 24 having stretchability, it is possible to make the opening 26 smaller than the wearer's head. Further, the body section 12 and the sleeve sections 14 include stretchable segments, so that it is possible to make the shirt 10 to snugly fit the wearer's body, while being comfortable.

Figure 7:
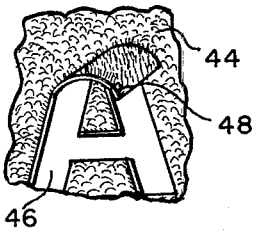
FIG. 7 is a fragmentary perspective view showing the ornament being removably secured to the loop elements of the main fabric.
Figure 6:
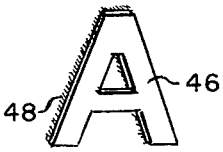
FIG. 6 is a perspective view of one embodiment of the ornaments according to the invention.

In FIG. 6, there is shown an ornament 46 in the form of the letter "A", which includes a plurality of hook elements 48 on a rear surface thereof. The hook elements 48 removably engage the loop elements 44 of the panels (see FIG. 7), whereby the ornament 46 is attached to the panels as desired.

Incidentally, in case the ornaments are not used, it is desirable to store them on a supplemental fabric having the loop elements 44 on an outer surface thereof. Therefore, the T-shirt is sold with the ornaments, the latter preferably attached to the supplemental fabric as a kit.

The material forming the main fabric or panels having loop elements thereon and the ornaments having hook elements are disclosed in U.S. Pat. Nos. 2,717,437, 3,009,235 and 2,154,807. Consequently, the detailed structure is not explained in the specification.

The invention has been described with reference to a specific embodiment, but it is to be understood that description is illustrative and the invention is only limited by the hereto appended claims.

What I claim is:

1. A kit comprising a close-fitting garment including a body portion and sleeve portions, said body portion having a neck opening smaller than a wearer's head but adapted for insertion of a wearer's head when the garment is donned, said garment being essentially composed of a non-stretchable main fabric having a plurality of small loop elements on the entire outer surface thereof, with the corresponding inner surface of the main fabric being coated with resin to ensure uniformity and integrity of the main fabric, the resin coating rendering the main fabric non-stretchable, and at least one ornament having a plurality of small hook elements on a rear surface thereof adapted to engage said loop elements of said main fabric so that the ornament is separably attachable to said garment, said body portion having an upper part surrounding the neck opening, said upper part being formed of a stretchable knitted fabric to permit the wearer's head to pass through the neck opening though the neck opening is smaller than the wearer's head, said body portion further including at least one knitted body strip extending in the longitudinal direction of the body portion and each sleeve portion including a knitted sleeve strip extending in the longitudinal direction of the sleeve portion, said body strip and sleeve strips being formed of a stretchable fabric, whereby, despite the non-stretchable character of the main fabric and the close-fitting cut of the garment, the garment is easily donned and no active movement is prohibited thereby.

2. A kit as claimed in claim 1, in which two body strips are provided, each extending along a respective side of the body portion of the garment.

3. A kit as claimed in claim 1, further comprising a supplemental fabric having a plurality of loop elements on an outer surface thereof for holding the ornaments thereon when the ornaments are not attached to the garment.

* * * * *